US009394642B2

(12) United States Patent
McMaster et al.

(10) Patent No.: US 9,394,642 B2
(45) Date of Patent: Jul. 19, 2016

(54) BASKET ASSEMBLY FOR A WASHING MACHINE

(75) Inventors: William J. McMaster, Berkeley Heights, NJ (US); Stephen P. Serna, Hopatcong, NJ (US); Gavin L. Jewell, Chicago, IL (US)

(73) Assignee: BASF SE, Ludwigshafen (DE)

( * ) Notice: Subject to any disclaimer, the term of this patent is extended or adjusted under 35 U.S.C. 154(b) by 665 days.

(21) Appl. No.: 12/667,086

(22) PCT Filed: Jun. 24, 2008

(86) PCT No.: PCT/EP2008/058013
§ 371 (c)(1),
(2), (4) Date: Jun. 7, 2010

(87) PCT Pub. No.: WO2009/003875
PCT Pub. Date: Jan. 8, 2009

(65) Prior Publication Data

US 2010/0251782 A1 Oct. 7, 2010

Related U.S. Application Data

(60) Provisional application No. 60/947,170, filed on Jun. 29, 2007.

(51) Int. Cl.
*D06F 37/02* (2006.01)
*D06F 37/12* (2006.01)

(52) U.S. Cl.
CPC ..... *D06F 37/12* (2013.01); *D06F 37/02* (2013.01)

(58) Field of Classification Search
CPC ..... D06F 37/12
See application file for complete search history.

(56) References Cited

U.S. PATENT DOCUMENTS 3,307,383 A 3/1967 Cobb et al.
3,548,617 A 12/1970 Wasemann
(Continued)

FOREIGN PATENT DOCUMENTS

DE 1236457 3/1967
EP 1506333 B1 2/2005
(Continued)

OTHER PUBLICATIONS

International Search Report dated Nov. 11, 2008, for International Application No. PCT/EP2008/058013, International filing date Jun. 24, 2008.
(Continued)

*Primary Examiner* — Michael Barr
*Assistant Examiner* — Jason Riggleman
(74) *Attorney, Agent, or Firm* — Howard & Howard Attorneys PLLC

(57) ABSTRACT

A basket assembly (24) for a washing machine includes a basket and a support bracket (36) adjacent the basket. The basket has a first end (54) and a second end (56) and defines a cavity at the first end for receiving laundry. The support bracket (36) includes a base (40) having a front side (42) and at least two attachment portions (60) extending from the front side. The attachment portions are spaced from each other and are connected to the second end (56) of the basket. At least two fins (74) integrally extend from the front side of the base toward the first end of the basket. The fins (74) are integral with the attachment portions (60) of the support bracket (36) for reinforcing the attachment portions.

21 Claims, 6 Drawing Sheets

(56) References Cited

U.S. PATENT DOCUMENTS

| | | | | | |
|---|---|---|---|---|---|
| 3,626,728 | A | | 12/1971 | Traube et al. | |
| 3,772,925 | A | | 11/1973 | Sisson | |
| 3,958,433 | A | | 5/1976 | Bochan | |
| 4,216,663 | A | | 8/1980 | Shacklock | |
| 4,232,536 | A | * | 11/1980 | Koseki et al. | 68/12.16 |
| 4,328,600 | A | | 5/1982 | Bochan | |
| 5,019,450 | A | * | 5/1991 | Cogswell et al. | 428/402 |
| 5,297,403 | A | | 3/1994 | Farrington et al. | |
| 5,373,715 | A | | 12/1994 | Sharp et al. | |
| 5,746,070 | A | * | 5/1998 | Bailey et al. | 68/24 |
| 5,784,902 | A | | 7/1998 | Pinkowski et al. | |
| 6,918,271 | B2 | | 7/2005 | Lim et al. | |
| 2005/0252252 | A1 | | 11/2005 | Lee et al. | |

FOREIGN PATENT DOCUMENTS

| | | | | | |
|---|---|---|---|---|---|
| JP | 6-205889 | | * | 7/1994 | D06F 37/04 |
| KR | 10-2005-0098839 | | * | 4/2007 | D06F 37/04 |
| WO | 03080915 | A2 | | 10/2003 | |
| WO | 2009003875 | A1 | | 1/2009 | |

OTHER PUBLICATIONS

Written Opinion, dated Nov. 11, 2008, for International Application No. PCT/EP2008/058013, International filing date Jun. 24, 2008.

English Abstract for German Patent Application No. DE1236457, filed Oct. 13, 1960.

* cited by examiner

BASKET ASSEMBLY FOR A WASHING MACHINE

CROSS-REFERENCE TO RELATED APPLICATIONS

The subject patent application claims priority to and all the benefits of International Patent Application No. PCT/EP2008/058013, filed on Jun. 24, 2008, which claims priority to U.S. Provisional Patent Application Ser. No. 60/947,170 which was filed on Jun. 29, 2007, the entire specification of which is expressly incorporated herein by reference.

BACKGROUND OF THE INVENTION

1. Field of the Invention

The present invention generally relates to a basket assembly for a washing machine and particularly a basket and support bracket of the basket assembly.

2. Description of the Related Art

Washing machines include a basket assembly for receiving materials to be washed. The basket assembly is rotatable to agitate such materials and the rotation of the basket assembly results in stress in the basket assembly.

The washing machine includes a tub that receives a supply of wash liquid. The tub is hollow and the basket assembly is disposed in the tub. The basket assembly includes a basket that is hollow and permeable to receive the wash liquid. The basket extends between a first end and a second end. The first end is open for receiving laundry and a back plate is crimped onto the second end. A bracket is mounted to the second end adjacent to the back plate. A drive rod is engaged with the bracket and the washing machine includes a motor engaging the drive rod to rotate the drive rod. The rotation of the drive rod by the motor rotates the basket assembly. This rotation exerts stresses on the basket and on the bracket.

The bracket is typically formed of metal to withstand the stresses resulting from the rotation of the drive rod. The metal is a relatively expensive material and is subject to corrosion from contact with the wash liquid. Further, the assembly process of the basket assembly involves several steps including crimping the back plate onto the second end of the basket and subsequently the bracket to the bracket. The several steps are time consuming. In addition, the crimping process is a time consuming process.

Accordingly, it would be advantageous to design a basket assembly for a washing machine that comprises fewer components and more inexpensive and corrosion resistant components such that the basket assembly is more durable while remaining more cost effective from a material/manufacturing standpoint as well as from an assembly standpoint.

SUMMARY OF THE INVENTION AND ADVANTAGES

The present invention includes a basket assembly for a washing machine. The basket assembly comprises a basket having an axis and a first end and a second end spaced along the axis and defining a cavity at the first end for receiving laundry. A support bracket is adjacent the second end of the basket. The support bracket comprises a base having a front side, at least two attachment portions extending from the front side and spaced from each other radially relative to the axis with the attachment portions connected to the basket at the second end, and at least two fins integrally extending from the front side of the base toward the first end of the basket wherein the fins are integral with the attachment portions of the support bracket for reinforcing the attachment portions.

The support bracket advantageously reduces the number of parts associated with the bracket assembly while maintaining sufficient strength, stiffness, and durability of the bracket assembly. Specifically, the support bracket replaces several components of the prior art basket by consolidating the back plate and the bracket of the prior art into a single component. The consolidation of parts reduces the number of steps required to assemble the basket assembly and eliminates the time consuming crimping process that is required to crimp the back wall onto the basket of the prior art. In addition, because the fins are integral with and reinforce the attachment portions, the support bracket has the strength, stiffness, and durability to withstand the stresses that the support bracket undergoes during various cycles of the washing machine.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
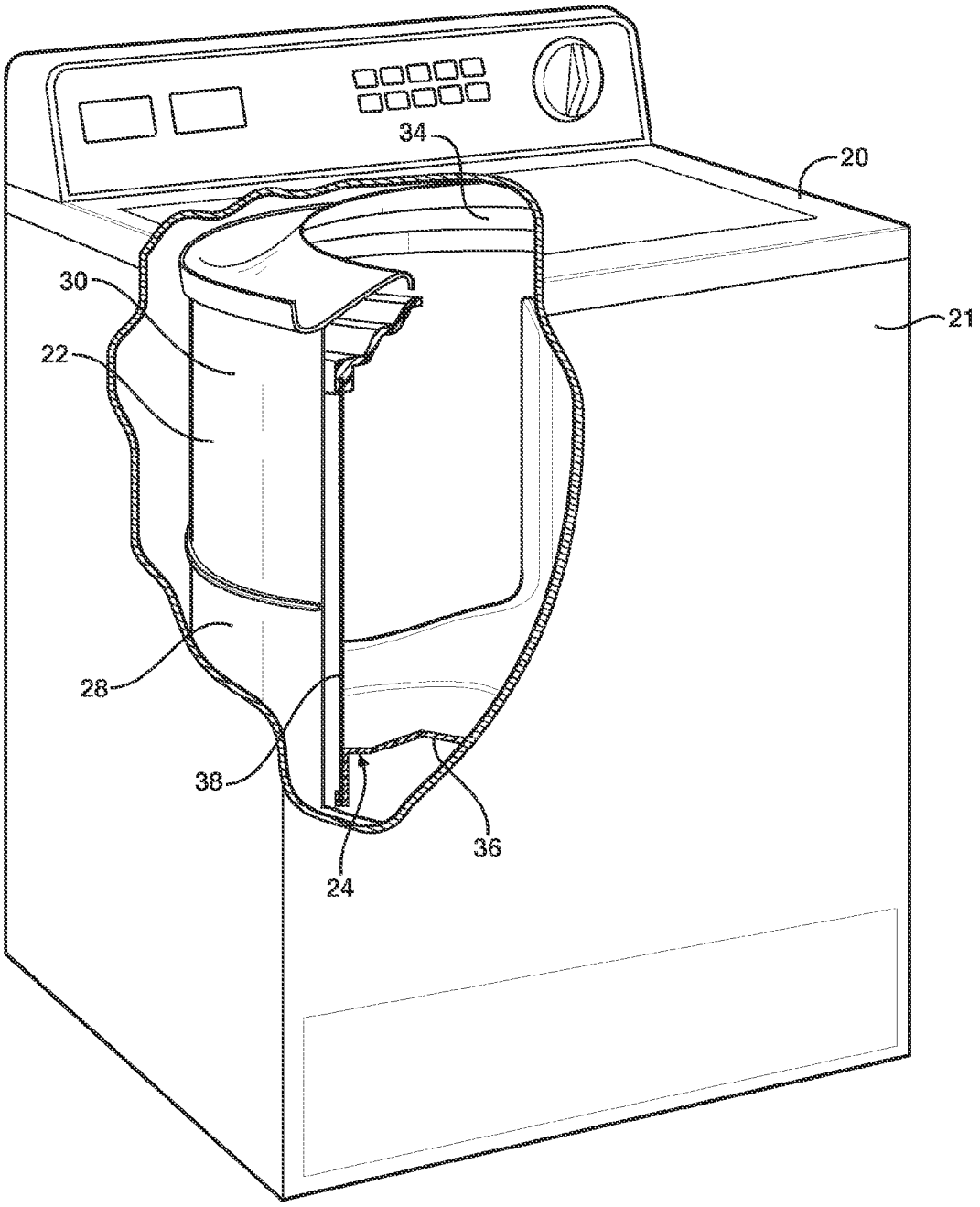
FIG. 1 is a cut-away perspective view of a washing machine including a basket assembly.

Referring to the Figures, wherein like numerals indicate corresponding parts throughout the several views, a basket assembly 24 for a washing machine 20, e.g., a washing machine for washing laundry, is generally shown. The washing machine 20 is also referred to in industry as an automatic washer. The washing machine 20 includes a cabinet 21 and a tub 22 disposed within the cabinet 21. It should also be appreciated that the washing machine 20 is not limited to a top-load unit as shown in FIG. 1 and could have a different configuration, e.g., a side-load unit, without departing from the nature of the present invention.

The tub 22 receives a supply of wash liquid, e.g., laundry detergent and water. The cabinet 21 includes a lid which is opened to access the tub 22 and which is closed to enclose the tub 22 within the cabinet 21.

The basket assembly 24 is partially disposed within the tub 22. As shown in FIGS. 2 and 4A-C, the basket assembly 24 includes a support bracket 36 and a basket 38 coupled to the support bracket 36. The basket 38 is hollow and receives a load of materials to be washed, e.g., laundry. The basket 38 is also referred to in industry as a wash basket.

The basket 38 has an axis A and a first end 54 and a second end 56 spaced along the axis A. The basket 38 includes a wall 52 extending between the first end 54 and the second end 56 defining a cavity 26 at the first end 54 for receiving laundry. The basket 38 is permeable, i.e., the cavity 26 is in fluid communication with the tub 22. Typically, the cavity 26 extends through the first end 54 and the second end 56, i.e., the basket 38 is open at both the first and second ends 54, 56; however, the basket 38 can be closed at the second end without departing from the nature of the present invention. The basket 38 is typically cylindrical. Typically, the basket 38 is formed of plastic or metal.

A motor (not shown) is typically disposed below the basket assembly 24 and is coupled to the support bracket 36. The motor rotates and/or oscillates the basket assembly 24 relative to the tub 22 to agitate the laundry and the wash liquid in the basket assembly 24.

As shown in FIG. 1, the tub 22 includes a first tub half 28 and a second tub half 30 attached to the first tub half 28. The first and second tub halves 28, 30 are typically cylindrical in shape and are hollow to receive the basket assembly 24 between the first and second tub halves 28, 30. The second tub half 30 defines an opening 34 and the lid is hinged to the second tub half 30 near the opening 34. The lid is opened to expose the opening 34 and is closed to enclose the opening 34. It should be appreciated that the tub 22 is described herein for exemplary purposes and the tub 22 can have any suitable configuration without departing from the nature of the present invention.

The basket assembly 24 is aligned in the tub 22 such that the cavity 26 of the basket assembly 24 is aligned with the opening 34 of the second tub half 30. As such, materials to be washed are loaded through the opening 34 of the second tub half 30 and into the cavity 26 of the basket when the lid is opened. The lid is typically closed for the washing process.

Figure 4A:
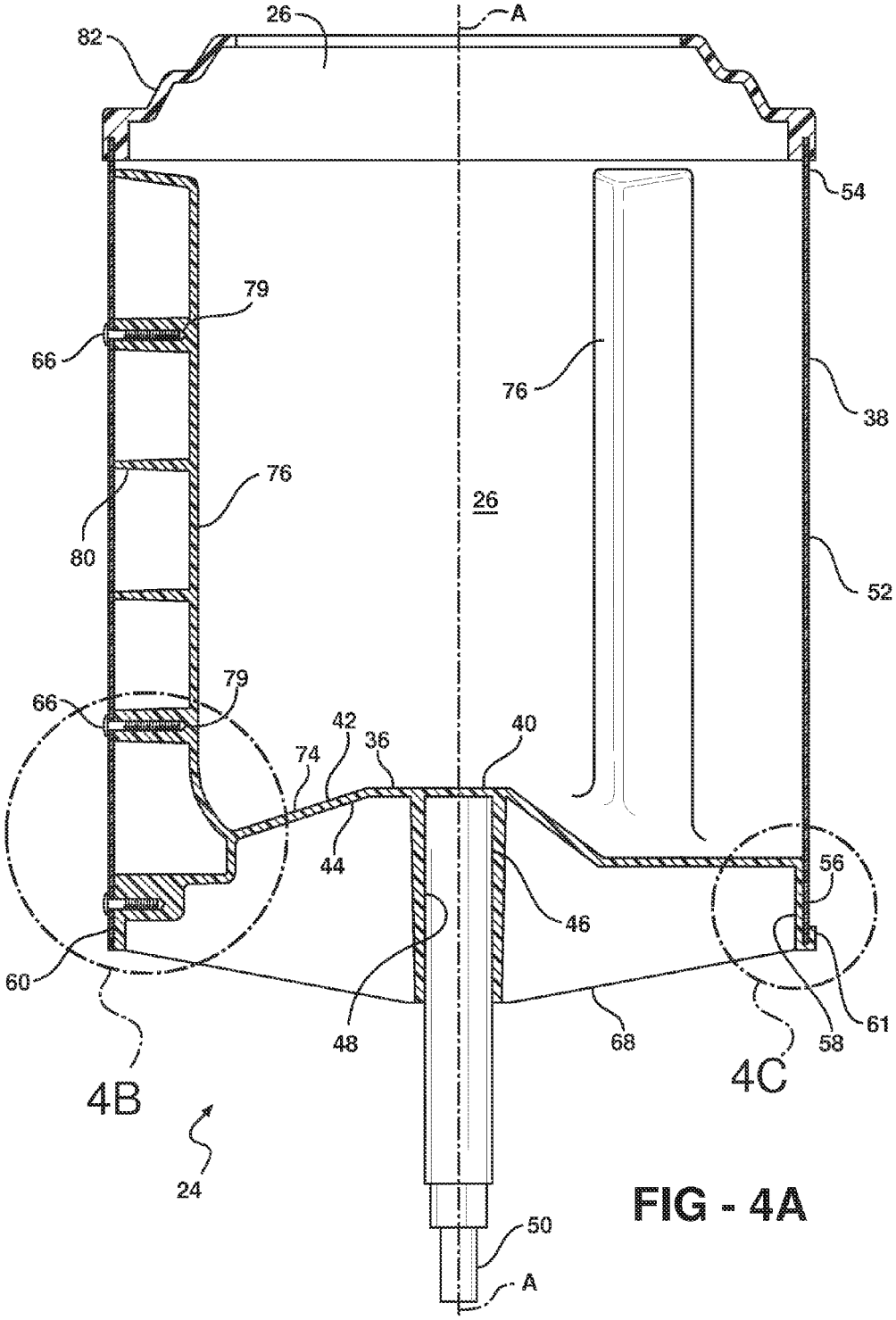
FIG. 4A is a cross-sectional view of the basket assembly along line 4 of FIG. 3.
Figure 4B:
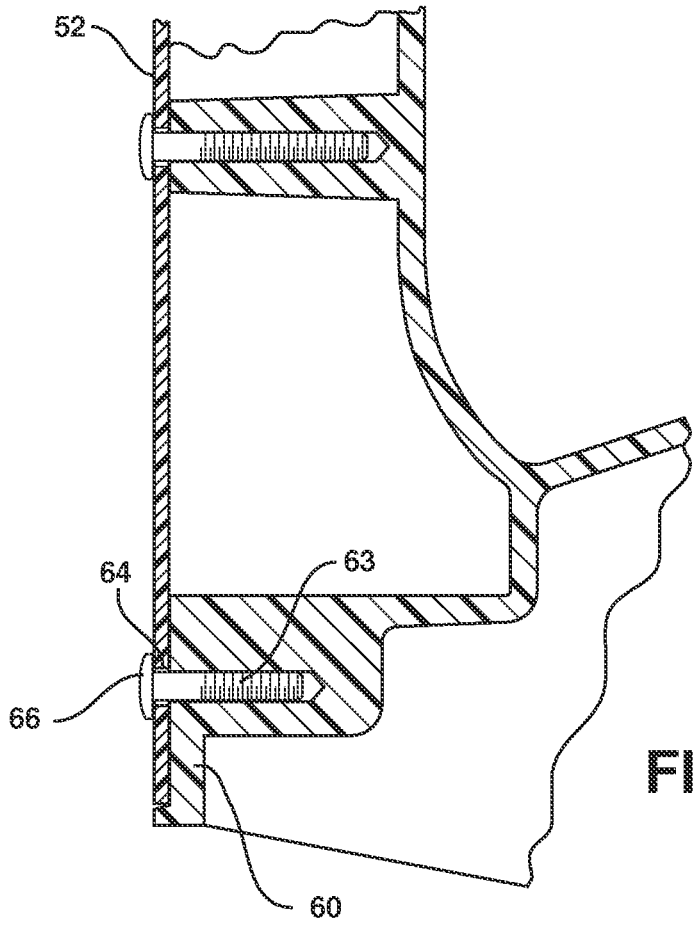
FIG. 4B is a magnified view of a portion of FIG. 4A.
Figure 4C:
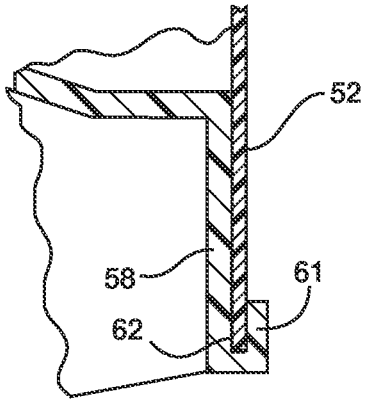
FIG. 4C is a magnified view of another portion of FIG. 4A.
Figure 5A:
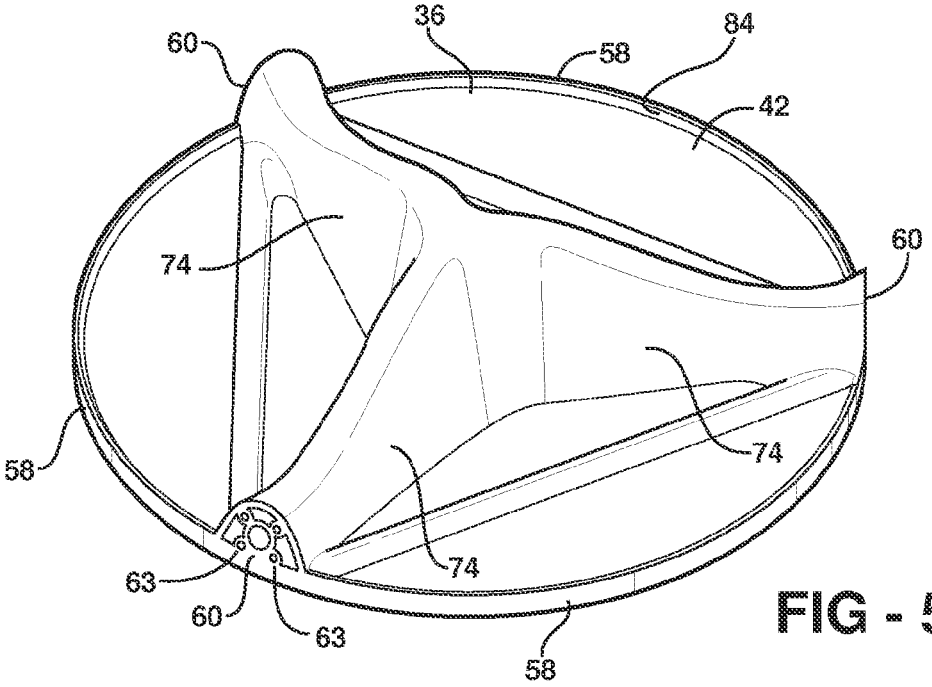
FIG. 5A is a perspective view of another embodiment of the support bracket.
Figure 5B:
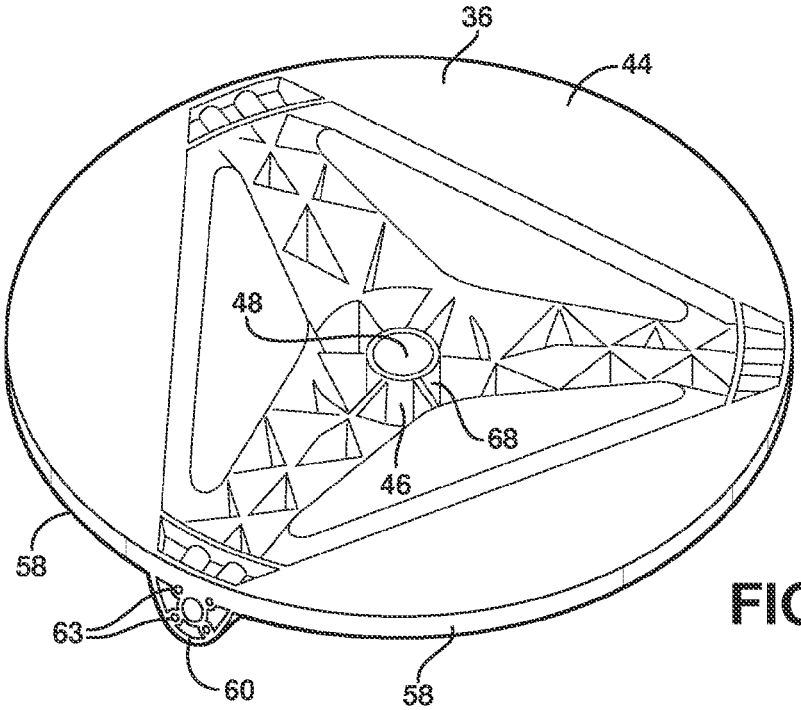
FIG. 5B is another perspective view of the embodiment shown in FIG. 5A.

One embodiment of the support bracket 36 is shown in FIGS. 1-4C and another embodiment of the support bracket 36 is shown in FIGS. 5A-B. As best shown in FIGS. 2-5B, the support bracket 36 includes a base 40. The base 40 typically has a cylindrical perimeter and presents a front side 42 facing the basket 38 and a back side 44 facing the first tub half 28. It should be appreciated that the perimeter of the base 40 typically abuts the basket 38 such that the perimeter of the base 40 is shaped correspondingly to the basket 38. As set forth below, the support bracket 36 is typically formed as a one-piece unit, i.e., all features of the support bracket 36 are integral. However, it should be appreciated that the support bracket 36 could be formed of individual parts subsequently attached together.

The support bracket 36 is formed from a plastic material and specifically a thermoplastic material. Specifically, the support bracket 36 is formed from polyalkylene terephthalate such as polybutylene terephthalate (PBT). The polyalkylene terephthalate can be reinforced with fiber such as, for example, glass fibers. When reinforced with glass, the polyalkylene terephthalate typically comprises 30%-50% glass content. An example of a fiber reinforced PBT suitable for the support bracket 36 are those which are commercially available from BASF Corporation in Florham Park, N.J. under the tradenames Ultradur® B4330 G6 HR or Ultradur® B4330 G10 HR. Another example of a fiber reinforced PBT suitable for the support bracket 36 are those which are commercially available from BASF Corporation under the tradenames Ultradur® B4040 G6 HR or Ultradur® B4040 G10 HR. It should be appreciated that the support bracket 36 may be formed from any type of suitable plastic material without departing from the nature of the present invention. In any event, the material of the support bracket 36 is preferably hydrolysis resistant. The support bracket 36 is typically formed by plastic injection molding.

Figure 3:
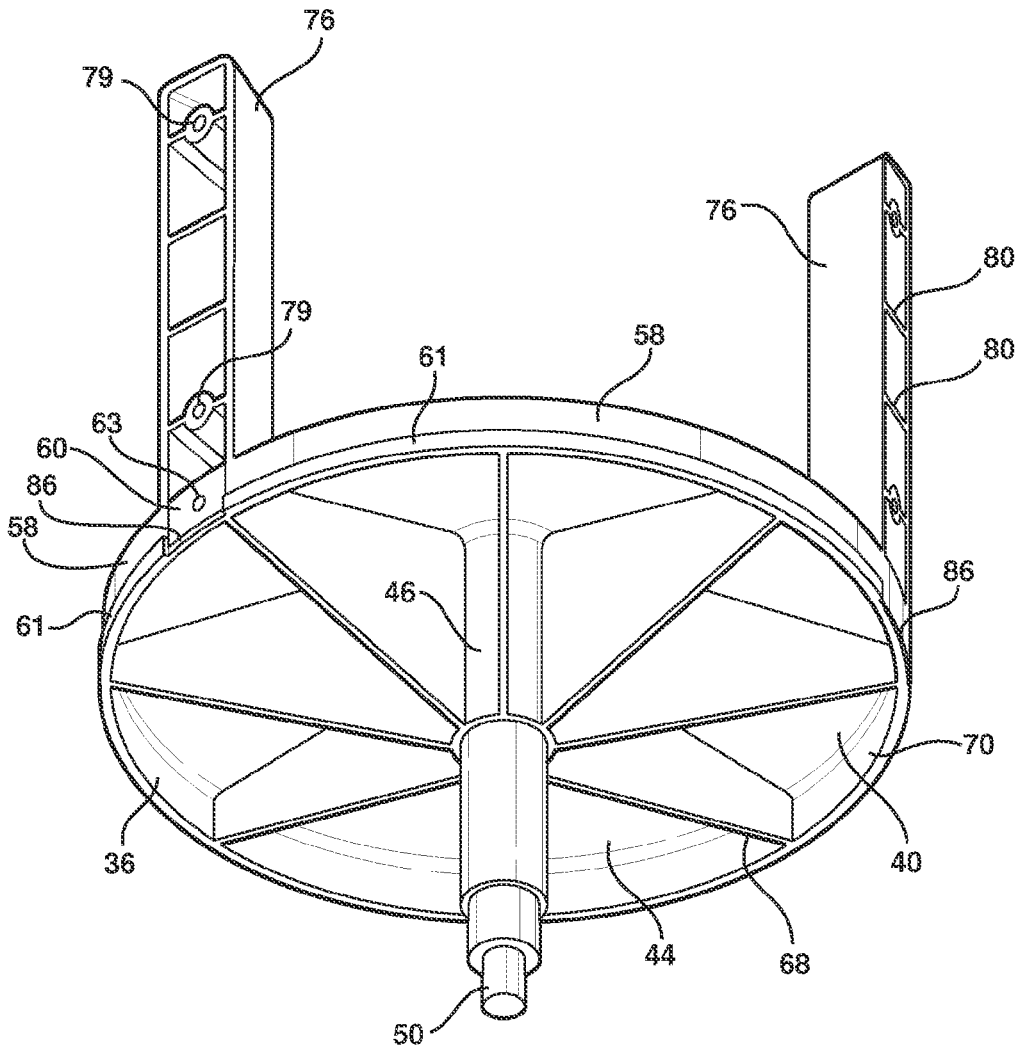
FIG. 3 is a perspective view of a support bracket of the basket assembly.

As shown in FIGS. 3, 4A, and 5A, the support bracket 36 includes a sleeve portion 46 integrally extending from the base 40, i.e., the sleeve portion 46 and the base 40 are formed as a single continuous unit. However, it should be appreciated that the base 40 and the sleeve portion 46 may be formed as separate pieces and subsequently attached to each other by, for example, adhesive, melt bonding, or mechanical fastening without departing from the nature of the present invention.

The sleeve portion 46 defines a bore 48 and a drive rod 50 is mounted in and extends from the bore 48. The drive rod 50 extends through a throughhole of the first tub half 28 and engages the motor of the washing machine. Alternatively, the drive rod 50 is coupled to the motor with, for example, a system including at least one belt and pulley. The combination of the sleeve portion 46 and the base 40 distributes the stress on the support bracket 36 allowing the support bracket 36 to survive high loads resulting from the rotation of the drive rod 50. The base 40 of the support bracket 36 is designed with a sufficient depth such that the support bracket 36 can survive such high loads. In addition, the combination of the sleeve portion 46 and the base 40 decreases the weight and increases the cost effectiveness of the support bracket 36.

The drive rod 50 is press fit into the bore 48 of the sleeve portion 46. Alternatively, the drive rod 50 is insert molded with the sleeve portion 46. The insert molding process includes placing the drive rod 50 in a plastic injection mold and subsequently injecting the molten plastic into the mold about a portion of the drive rod 50. In any event, the drive rod 50 is engaged in the bore 48 of the sleeve portion 46 and the drive rod 50 and the sleeve portion 46 are immovable relative to each other.

As best shown in FIGS. 3 and 5A, the support bracket 36 includes a plurality of ribs 68 extending from the back side 44 of the base 40. In the embodiment shown in FIG. 3, the support bracket 36 includes a lip 70 extending around the perimeter of the base 40 and the ribs 68 are attached to the lip 70. The ribs 68 increase the strength and the stiffness of the support bracket 36. The base 40, the ribs 68, and the lip 70 are integral with each other, i.e., the base 40, the ribs 68, and the lip 70 are formed as a single continuous unit. It should be appreciated that the base 40, the ribs 68, and the lip 70 may be formed as separate pieces and subsequently attached to each other by, for example, adhesive, melt bonding, or mechanical fastening without departing from the nature of the present invention.

As shown in FIGS. 2-4C, the support bracket 36 includes a plurality of attachment portions 60 and a plurality of intermediate portions 58. Each attachment portion 60 extends from the front side 42 of the base 40 and the attachment portions 60 are spaced from each other radially relative to the axis A. Each of the intermediate portions 58 extend from the front side 42 and are spaced from each other radially relative to the axis in alternating arrangement with the attachment portions 60. In the embodiments shown in the Figures, the support bracket 36 has three attachment portions 60 and three intermediate portions 58; however, it should be appreciated that the support bracket 36 can have any number of attachment portions 60 and intermediate portions 58 without departing from the nature of the present invention.

The attachment portions 60 are connected to the basket 38 to transfer rotation from the support bracket 36 to the basket 38 when the motor rotates the support bracket 36. For example, a fastener 66 extends through one of the basket 38 and the attachment portion 60 and into the other of the basket 38 and the attachment portion 60. In the embodiments shown in the Figures, each of the attachment portions 60 defines at least one hole 63 and the basket 38 defines at least one orifice 64 corresponding with the hole 63 in the attachment portion 60 such that orifice 64 can be aligned with the hole 63. The fastener 66 extends through orifice 64 and engages the corresponding hole 63. For example, the fastener 66 is a rivet or a threaded fastener such a screw.

The intermediate portions 58 typically abut the basket 38 for supporting the basket 38 to maintain the shape of the basket 38 when the basket 38 is rotated. Specifically, during rotation of the basket assembly 24, the laundry and the wash liquid exert centrifugal forces on the basket 38. The intermediate portions 58 limit or prevent the deformation of the basket 38 as the basket 38 is rotated.

The support bracket 36 typically covers the cavity 26 at the second end 56 of the basket 38 to support laundry that is loaded into the cavity 26. The attachment portions 60 and the intermediate portions 58 are at least partially disposed in the cavity 26 and are typically entirely disposed in the cavity 26. The attachment portions 60 extend toward the first end 54 of the basket 38 adjacent the basket 38.

The support bracket 36 has a plurality of fins 74 integrally extending from the front face 42 of the base 40 toward the first end 54 of the basket 38. The fins 74 are integral with the attachment portions 60 of the support bracket 36 for reinforcing the attachment portions 60. The fins 74 typically extend from the attachment portions 60 toward the axis A. The fins 74 also typically extend toward the axis A and intersect each other at the axis A.

The fins 74 support and reinforce the attachment portions 60 to increase the strength, stiffness, and durability of the support bracket 36 at the attachment portions 60. When the motor rotates the support bracket 36, the rotation is transferred from the support bracket 36 to the basket 38 at the attachment portions 60. This rotational transmission results in stresses at the attachment portions 60. The fins 74 reinforce the attachment portions 60 and distribute such stress to other parts of the base 40. In addition, the fins 74 assist in agitating the laundry and the wash liquid as the basket assembly 24 is rotated.

Figure 2:
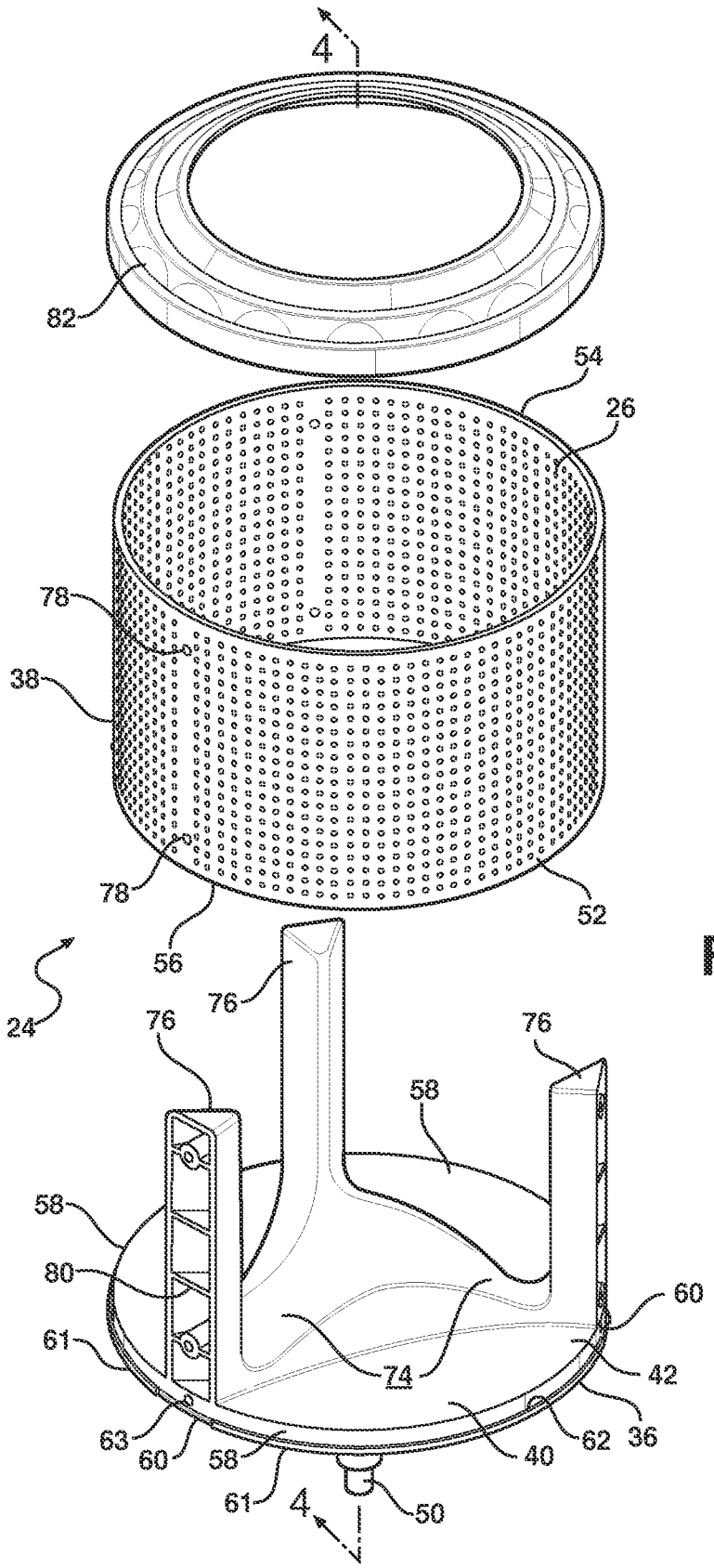
FIG. 2 is an exploded view of the basket assembly.

In addition to the fins 74, the basket assembly 24 may include an agitator (not shown), e.g., an auger, attached to the base 40 and extending from the front side 42 of the base 40. As best shown in FIGS. 2 and 4, the basket assembly 24 includes a front ring 82 mounted to the second end 56 of the basket 38. The front ring 82 is attached to the basket 38 with, for example, rivets or threaded fasteners.

In the embodiment shown in FIGS. 1-4C, the support bracket 36 defines a channel 62 with the basket 38 partially disposed in the channel 62 at the second end 56 of the basket 38. Specifically, the support bracket 36 includes outer walls 61 spaced outwardly from the intermediate portions 58 relative to the axis A defining the channel 62 between the outer walls 61 and the intermediate portions 58.

The outer walls 61 extend along the intermediate portions 58 between the attachment portions 60. The outer walls 61 are spaced from each other radially relative to the axis A defining a space 86 between adjacent outer walls 61. The space 86 extends radially relative to the axis A and outwardly from the attachment portion 60 relative to the axis A. The basket 38 extends across the space 86 from one channel 62 to another channel 62. The basket 38 is typically connected to the attachment portion 60 at the space 86.

As shown in FIGS. 2-4A, the support bracket 36 includes arms 76 extending upwardly from the fins 74. The arms 76 are integral with the base 40 and the fins 74, i.e., the base 40 and the fins 74 are formed as a single continuous unit. It should be appreciated that the arms 76 and the base 40 and the fins 74 may be formed as separate pieces and subsequently attached to each other by, for example, adhesive, melt bonding, or mechanical fastening without departing from the nature of the present invention.

Each arm 76 defines at least one fastener hole 79 and the basket 38 defines at least one fastener orifice 78 corresponding with the fastener hole 79 in the arm 76 such that each fastener orifice 78 aligns with one of the fastener holes 79 when the basket 38 is mounted to the base 40. A fastener 66 extends through each of the fastener orifices 78 and engages the corresponding fastener hole 79. For example, the fastener 66 is a rivet or a threaded fastener such a screw. The arms 76 typically include reinforcing ribs 80.

The arms 76 reinforce the basket 38 to prevent deformation of the basket 38 as the basket assembly 24 is rotated. In addition, the arms 76 reinforce the attachment portions 60 by absorbing stress from the basket 38.

In the embodiment shown in FIGS. 5A-B, the support bracket 36 includes flanges 84 extending from the intermediate portions 58 toward the first end 54 of the basket 38 adjacent the basket 38. The flanges 84 typically extend in alternating arrangement with the attachment portions 60 and extend from one attachment portion 60 to another attachment portion 60.

The flanges 84 abut the basket 38 for reinforcing the basket 38 to prevent deformation of the basket 38. In addition, the flanges 84 reinforce the attachment portions 60.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A basket assembly for a vertical axis washing machine having a shaft, said basket assembly comprising:

a basket having an axis and a first end and a second end spaced along said axis and defining a cavity at said first end for receiving laundry, and a ring fixed to said basket at said first end of said basket and defining an opening about said axis for receiving laundry at the first end;

a support bracket adjacent said second end of said basket and being formed of a thermoplastic, said support bracket comprising:

a base having a front side and a rear side, said rear side having a portion adapted to directly receive the shaft, at least two attachment portions extending from said front side and spaced from each other radially relative to said axis with said attachment portions connected to said basket at said second end, at least two fins intersecting at a hub disposed along said axis of said basket with said fins extending radially from said hub, said fins integrally extending from said front side of said base toward said first end of said basket, wherein said fins terminate at ends spaced from said hub with said attachment portions disposed at said ends, respectively, and fasteners extending through said second end of said basket and into said attachment portions for attaching the support bracket to the basket.

2. The basket assembly as set forth in claim 1 wherein said attachment portions are adjacent said basket.

3. The basket assembly as set forth in claim 1 wherein said fins extend from said attachment portions toward said axis.

4. The basket assembly as set forth in claim 1 wherein said support bracket includes at least two intermediate portions extending from said front side and spaced from each other radially relative to said axis in alternating arrangement with said attachment portions.

5. The basket assembly as set forth in claim 4 wherein each intermediate portion extends from one attachment portion to another attachment portion.

6. The basket assembly as set forth in claim 4 wherein at least one of said attachment portions and said intermediate portions are at least partially disposed in said cavity.

7. The basket assembly as set forth in claim 4 further comprising a flange extending from one of said intermediate portions toward said first end of said basket adjacent said basket.

8. The basket assembly as set forth in claim 7 wherein said flange is further defined as at least two flanges extending in alternating arrangement with said attachment portions and extending from one attachment portion to another attachment portion.

9. The basket assembly as set forth in claim 6 wherein said support bracket defines a channel with said basket partially disposed in said channel at said second end of said basket.

10. The basket assembly as set forth in claim 9 further comprising at least one outer wall spaced outwardly from at least one of said intermediate portions relative to said axis defining said channel between said outer wall and said intermediate portion.

11. The basket assembly as set forth in claim 10 wherein said outer wall is further defined as at least two outer walls extending along said intermediate portions between said attachment portions with said outer walls defining a space between said outer walls with the space extending radially relative to said axis and outwardly from at least one of said attachment portions relative to said axis.

12. The basket assembly as set forth in claim 11 wherein said basket extends across said space and said basket is connected to said attachment portion at said space.

13. The basket assembly as set forth in claim 12 wherein said fastener is at said space.

14. The basket assembly as set forth in claim 1 wherein said attachment portions and said intermediate portions are at least partially disposed in said cavity.

15. The basket assembly as set forth in claim 1 wherein said cavity extends through said second end.

16. The basket assembly as set forth in claim 15 wherein said support bracket covers said cavity at said second end of said basket.

17. The basket assembly as set forth in claim 1 wherein said support bracket is formed of polyalkylene terephthalate.

18. The basket assembly as set forth in claim 17 wherein said polyalkylene terephthalate is reinforced with fiber.

19. The basket assembly as set forth in claim 17 wherein said polyalkylene terephthalate is reinforced with glass fibers and said polyalkylene terephthalate comprises 30%-50% glass content.

20. The basket assembly as set forth in claim 1 wherein said base defines a perimeter extending about said axis with said perimeter abutting said basket.

21. A vertical axis washing machine comprising:

a shaft;

a basket having an axis and a first end and a second end spaced along said axis and defining a cavity at said first end for receiving laundry;

a ring fixed to said basket at said first end of said basket and defining an opening about said axis for receiving laundry at the first end;

a support bracket adjacent said second end of said basket and being formed of a thermoplastic, said support bracket comprising:

a base having a front side and a rear side, said shaft directly fitting into said rear side of said support bracket, at least two attachment portions extending from said front side and spaced from each other radially relative to said axis with said attachment portions connected to said basket at said second end, at least two fins intersecting at a hub disposed along said axis of said basket with said fins extending radially from said hub, said fins integrally extending from said front side of said base toward said first end of said basket, wherein said fins terminate at ends spaced from said hub with said attachment portions disposed at said ends, respectively, and fasteners extending through said second end of said basket and into said attachment portions for attaching the support bracket to the basket.

* * * * *